United States Patent [19]

Asari et al.

[11] 4,112,723

[45] Sep. 12, 1978

[54] HYDROSTATIC EXTRUSION APPARATUS

[75] Inventors: Akira Asari, Osaka; Hidehiro Tsuzuki, Toyonaka, both of Japan

[73] Assignee: Kobe Steel, Ltd., Kobe, Japan

[21] Appl. No.: 798,572

[22] Filed: May 19, 1977

Related U.S. Application Data

[62] Division of Ser. No. 629,891, Nov. 7, 1975, Pat. No. 4,083,214.

[30] Foreign Application Priority Data

Nov. 7, 1974 [JP] Japan ..... 49/28758
Nov. 7, 1974 [JP] Japan ..... 49/28759

[51] Int. Cl.[2] ..... B21D 22/10

[52] U.S. Cl. ..... 72/60; 72/263; 72/265; 72/272

[58] Field of Search ..... 72/60, 265, 270, 263, 72/420, 422, DIG. 31, 272

[56] References Cited

U.S. PATENT DOCUMENTS

| | | | |
|---|---|---|---|
| 2,188,076 | 1/1940 | Dinzl | 72/270 X |
| 2,713,941 | 7/1955 | Schuler | 72/265 X |
| 2,753,994 | 7/1956 | Bridge | 72/270 X |
| 3,531,965 | 10/1970 | Nilsson | 72/60 |
| 3,616,672 | 11/1977 | Moos | 72/270 |
| 3,709,014 | 1/1973 | Landa et al. | 72/60 |
| 3,789,642 | 2/1974 | Nilsson | 72/60 |
| 4,023,390 | 5/1977 | Nishihara et al. | 72/60 |

*Primary Examiner*—Leon Gilden
*Attorney, Agent, or Firm*—Oblon, Fisher, Spivak, McClelland & Maier

[57] ABSTRACT

A hydrostatic extrusion process and an apparatus therefor includes a mandrel and a stem which are movable independently of each other, and a seal block which is utilized for increasing the pressure of the pressure medium for performance of the extrusion operation of the billet. A supply device pre-disposes an extrusion die, a billet, pressure medium, and a seal block within a supply unit or sleeve and is capable of being moved from a position exterior of the extrusion apparatus station to a position corresponding to the extrusion station, and in this manner, the time period required for completing extrusion cycles is substantially reduced. Still further, a locking mechanism, including a locking slide and a locking plate, are operatively associated with the mandrel for controlling or limiting the axial movement of the mandrel so as to in turn control the loading and tensioning of the same in order to prevent damage thereto.

3 Claims, 7 Drawing Figures

HYDROSTATIC EXTRUSION APPARATUS

This is a division, of application Ser. No. 629,891, filed Nov. 7, 1975 now U.S. Pat. No. 4,083,214.

BACKGROUND OF THE INVENTION

1. Field of the Invention

The present invention relates generally to an extrusion process and apparatus therefor, and more particularly to a hydrostatic extrusion process and apparatus therefor whereby the time period for an extrusion cycle may be shortened and damage to the extrusion mandrel, when used to extrude tubular members, may be prevented.

2. Description of the Prior Art

A hydrostatic extrusion process is well known as the most efficient plastic working process since it provides a high lubricity between the billet and the extrusion die thereby facilitating extrusion at a high extrusion ratio. Within conventional hydrostatic extrusion processes, however, the pressure medium is frequently recovered each time an extrusion is completed, and several steps, such as, for example, charging a billet into the container and supplying the pressure medium thereinto, and the like, are required to be performed before performance of the extrusion operation. Consequently, it is difficult to perform an extrusion of a material in a continuous manner, and therefore, efficient workability of the hydrostatic extrusion cannot be reflected in substantial productivity.

Within a known hydrostatic extrusion press of the type which performs extrusion of hollow material, a mandrel holding fixture is fixedly connected to columns which are caused to extend, due to the compression load applied to the mandrel during the extrusion, and to contract when the extrusion pressure is released, whereby the mandrel is subjected to such extreme compression loads and is consequently damaged thereby. Another problem inherent in this type of prior art resides in the fact that it is difficult to initially provide complete sealing between a hollow billet and the mandrel and to simultaneously be able to move the mandrel to a suitable position at which the extrusion starting pressure may be applied.

SUMMARY OF THE INVENTION

The present invention contemplates overcoming the shortcomings encountered within the prior art hydrostatic extrusion processes and apparatus. In accordance with the present invention, a hydrostatic extrusion press employs a mandrel and a stem which are movable independently of each other, and a seal block is utilized to increase the pressure of the pressure medium for thereby performing the extrusion of the billet, whereby the time period required for completing one extrusion cycle is substantially reduced. A mandrel holding device is movably mounted upon a fixed mounting structure, such as, for example, columns, for supporting the compression load acting upon the mandrel and for holding the mandrel at a constant position, whereby when the extrusion pressure is released, the force acting upon the mandrel is correspondingly reduced thereby preventing the mandrel from being damaged, the mandrel also being freely movable in order to provide initial sealing between the hollow billet and the mandrel and for increasing the extrusion pressure when commencing extrusion.

In accordance with a first feature of the present invention, an extruding die, billet, pressure medium, and seal block are prepared, in a sealed condition, within a supply unit or sleeve at a position separated from and independent of the extrusion position. This supply unit is subsequently moved to a position coaxially aligned with the central axis of the extrusion press, and subsequently, the stem is moved forwardly thereby pushing the seal block into the container whereby the die, billet, and pressure medium are maintained in a sealed condition within the container.

In the instance that a hollow product is extruded, the bore of the seal block for passing the mandrel therethrough, and the aperture within the front end of the billet, are sealed by means of suitable material, such as, for example, foils or a pressure medium having a high viscosity so as to prevent the pressure medium from flowing out through the bore of the seal block and the bore within the front end of the billet. The seal block is recovered when the container is moved rearwardly after the extrusion has been completed and the pressure medium is likewise recovered. Consequently, replacement of the seal blocks can be made at a position exteriorly of the extrusion press, and therefore, it is unnecessary to terminate the operation of the extrusion press during replacement of the seal blocks because it is unnecessary to replace the seal block mounted upon the leading end of the stem within the press as in the prior art.

In accordance with a second feature of the present invention, the mandrel is passed through the throughbore of the seal block disposed within the container and the same is held within the container. The pressure of the pressure medium is increased by means of the forward movement of the stem, through means of the seal block, and the hollow billet is extruded as a result of the hydrostatic pressure within the pressure medium. The mandrel extends through a main cylinder for actuating the mandrel and has a piston portion disposed within the main cylinder. The mandrel is also provided with a large diameter portion formed upon a projecting portion extending rearwardly of the main cylinder. A lock slide is provided, which is movably supported by means of a lock slide actuating cylinder, at a position rearwardly of the large diameter portion of the mandrel and has a bore larger in diameter than that of the large diameter portion of the mandrel. A lock plate is interposed between the large diameter portion of the mandrel and the lock slide and has a diameter larger than that of the large diameter portion of the mandrel, the lock plate being arranged to be movable forwardly or rearwardly at right angles to the extrusion direction.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIG. 7 is a cross-sectional view illustrating a method of recovering the pressure medium, seal block, and the like.

DETAILED DESCRIPTION OF THE ILLUSTRATED EMBODIMENTS

Figure 1:
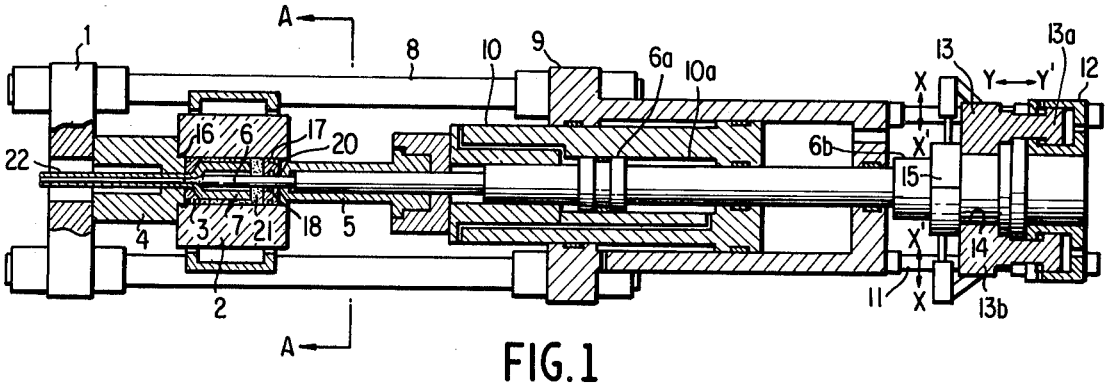
FIG. 1 is a cross sectional view of one embodiment of hydrostatic extrusion apparatus constructed in accordance with the present invention.
Figure 2:
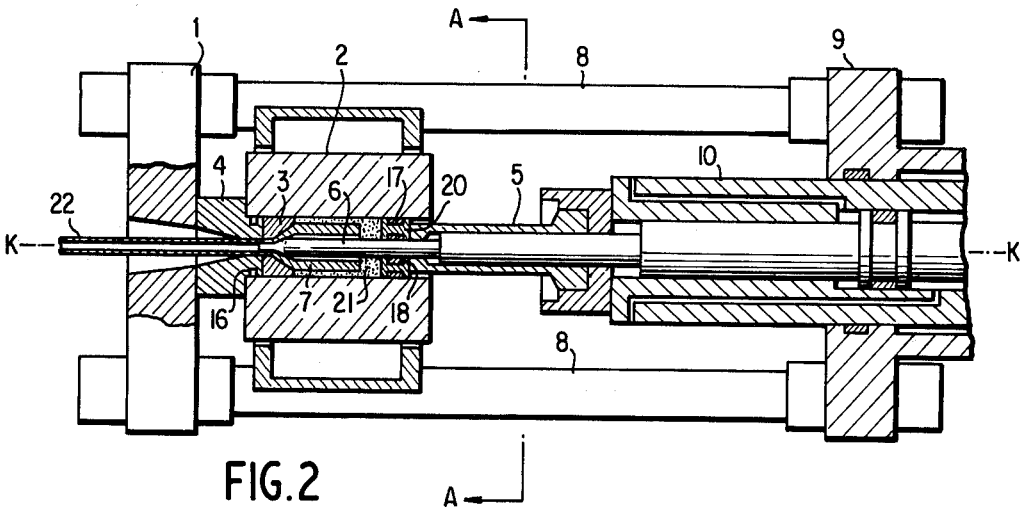
FIG. 2 is an enlarged sectional view of the apparatus of FIG. 1, showing an extrusion station thereof.

Referring now to the drawings and more particularly to FIGS. 1 and 2 thereof, there is shown an embodiment of a hydrostatic extrusion device constructed in accordance with the present invention. As shown, the hydrostatic extrusion device includes a press platen 1, an annular container 2, an extruding die 3 mounted within the front end of the container 2, a die holding fixture 4 interposed between die 3 and platen 1 for holding the die 3, a stem 5 disposed rearwardly of, and within the rear end of, the container 2 and being movable forwardly and rearwardly, and a mandrel 6 slidably disposed within the stem 5 and extending within, and toward the front end of, the container 2. A hollow billet 7 engages, at its front end, the extruding die 3, and the mandrel 6 extends through the hollow billet 7.

The stem 5 is connected, at its rear end, to a main piston 10, which is slidably disposed within a main cylinder 9 fixedly secured to a plurality of axially extending columns 8, and is movable along with the main piston 10. The main piston 10 is formed as a hollow cylinder whereby the main piston 10 serves as a cylinder which permits slidable movement of the mandrel 6 to occur relative thereto. The mandrel 6 is provided with a first large diameter portion 6*a* which serves as a piston slidably disposed within a cylindrical bore 10*a* of the main piston 10 and the mandrel 6 also has its rear end projecting axially outwardly from the main cylinder 9 with a second large diameter portion 6*b* provided upon its rear end.

An annular lock slide actuating cylinder 12 is disposed rearwardly of the second large diameter portion 6*b* of the mandrel 6, and is fixedly secured to a plurality of axially extending, auxiliary columns 11. An annular lock slide 13 is disposed rearwardly of the large diameter portion 6*b* of the mandrel 6 and has its rear end provided with a piston portion 13*a* which is slidably disposed within the cylinder 12 with ports provided in cylinder 12 on either side of piston portion 13*a* so as to be movable in the directions as shown by the arrows Y—Y' within FIG. 1. The lock slide 13 is formed, at its central portion, with a bore 14 which is larger in diameter than the large diameter portion 6*b* of the mandrel 6 so as to thereby permit the entrance of the large diameter portion 6*b* into bore 14.

A lock plate 15 is interposed between the second large diameter portion 6*b* of the mandrel 6 and the lock slide 13 and is larger in size than the diameter of the bore 14, the lock plate 15 being arranged to be movable in the directions shown by the arrows X—X' within FIG. 1. High pressure packings are disclosed at 16–18, packings 17 and 18 being disposed within an annular seal block 20.

The hydrostatic extrusion device of the present invention operates as follows:

As shown within FIG. 2, the hollow billet 7 is disposed coaxially within the container 2 along the axis K—K of the device, and a pressure medium 21 is charged into the container 2. The stem 5 is then moved forwardly thereby increasing the pressure within the pressure medium 21 by means of the seal block 20 whereby hydrostatic pressure is produced within the container 2 and, thus, a product 22 is formed by means of the extruding die 3 and the mandrel 6. The high pressure packing 16 serves as a sealing member in order to provide sealing between the forward end of the container 2 and the die holding fixture 4.

Figure 3:
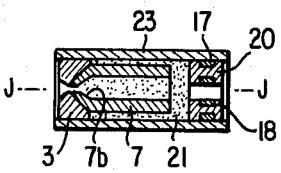
FIG. 3 is a cross-sectional view of a billet supply unit to be utilized within the apparatus of FIG. 1.
Figure 4:
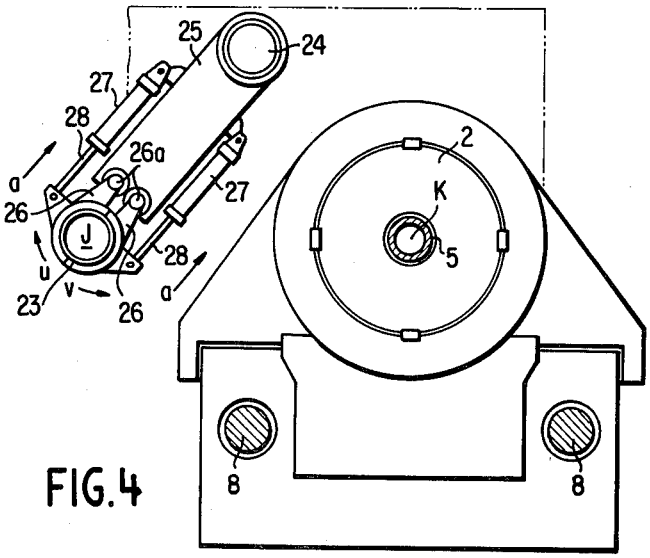
FIG. 4 is a cross-sectional view of the apparatus of FIG. 1 taken along the line A—A of FIG. 1 illustrating one example of a feeding device of the supply sleeves or units of FIG. 3.

In a preferred embodiment of the present invention, and with particular reference being made to FIGS. 3 and 4, there is provided a supply unit 23 which is disposed along the central axis J—J of an auxiliary station disposed exteriorly of the hydrostatic extrusion device. The supply unit 23 has a predetermined length, and an inner diameter approximately equal to that of the container 2. The supply unit 23 is provided with an extruding die 3, with which a new billet 7 is engaged, and is also filled with a predetermined amount of pressure medium 21, the seal block 20 also being disposed within the rear end thereof.

As shown within FIG. 4, the supply unit 23 is comprised of two longitudinally divided parts or halves which are respectively supported by means of the lower end of a swinging arm 25 swingingly pivoted by means of a pivot shaft 24 disposed at the apex of an equilateral triangle defined by the disposition of shaft 24, the center J of the auxiliary station, and the center K of the extrusion device, the base of the triangle being aligned with a segment of a line J–K interconnecting the center J of the auxiliary station and the center K of the extrusion device, in such a manner that the divided parts are capable of being opened.

More specifically, a pair of levers 26 are interposed between the divided halves of the unit 23 and the swinging arm 25 and are pivotally supported upon the arm 25 by means of pivot pins or shafts 26*a*. A pair of actuating cylinders 27 are mounted upon both sides of arm 25 and have piston rods 28 respectively connected to the levers 26, and with this arrangement, if the actuating cylinders 27 are concurrently actuated so as to cause the piston rods 28 to retract in the direction shown by the arrows *a*, the levers 26 will be rotated about the pivots 26*a* whereby the divided halves of the supply unit 23 are opened in the directions shown by the arrows *u* and *v*.

At the location J of the auxiliary station, the supply unit 23 is charged with the die 3, billet 7, pressure medium 21 and seal block 20, in a consecutive manner, and the same is then retained in a waiting condition for subsequent charging into container 2. In order to place the supply unit 23 in its charging position, the pivot shaft 24 is rotated counter-clockwise through a predetermined angle, as viewed within FIG. 4, whereby the pivotable arm 25 is swung so as to cause the axis J of the supply unit 23 to be aligned with the axis K of the extrusion device.

Figure 5:
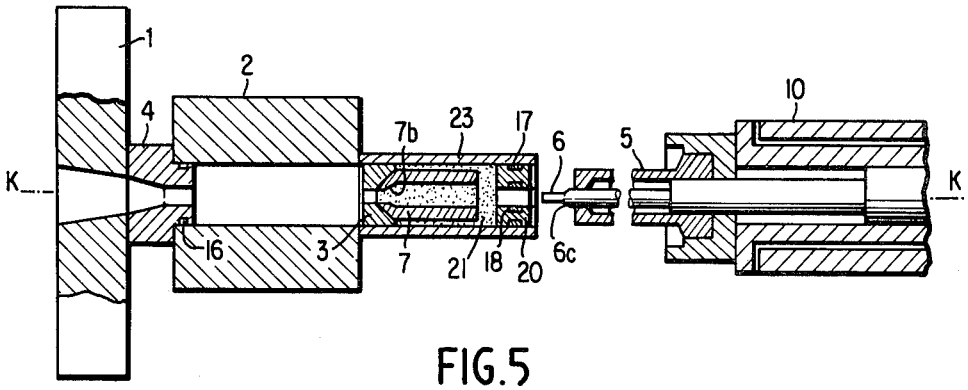
FIG. 5 is a longitudinal cross-sectional view illustrating the feeding process of the extrusion die, billet, pressure medium, and seal block utilized within the embodiment of the present invention.

As shown within FIG. 5, the supply unit 23 is then retained at the charging position within which the forward end of the supply unit 23, provided with the die 3, is held in close contact with the container 2 and coaxial alignment with the axis thereof. Thereafter, a metal foil, covering the rear end of the bore of the seal block 20, is broken by means of the leading end of the mandrel 6 which passes through the bore of the annular block 20. In this instance, the stem 5 is also moved forwardly thereby contacting the seal block 20 which is consequently moved forwardly, and in this manner, the die 3, billet 7, pressure medium 21 and seal block 20 are focibly moved into the container 2 in consecutive order. It is to be understood in this instance that residual air within container 2 is preferably exhausted therefrom by suitably known exhaust or vent means, not shown.

As shown within FIG. 6, the supply unit 23 is subsequently opened by means of the actuating cylinders 27 (see FIG. 4) after the die 3, billet 7, pressure medium 21, and seal block 20 have been completely charged into the container 2, whereupon the stem 10 and mandrel 6 can be moved forwardly still further for achieving the extrusion operation. Under these circumstances the swinging arm 25 is rotated in the clockwise direction, as viewed within FIG. 4, so as to cause the opened supply unit 23 to move back to its original position, within which the supply unit 23 is closed and supplied with a new extruding die, billet, pressure medium and seal block.

Figure 6:
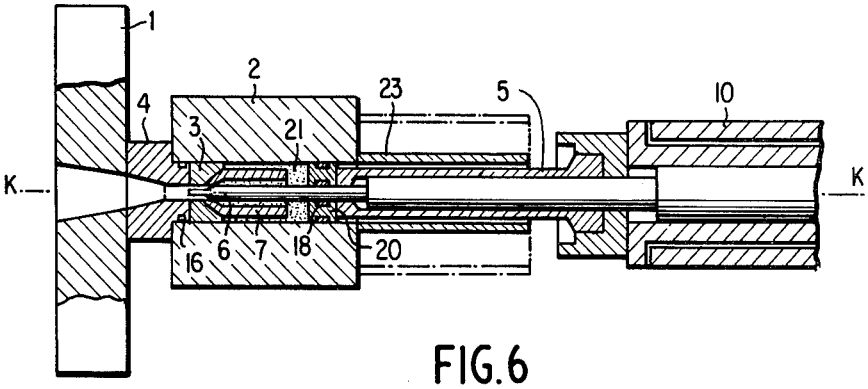
FIG. 6 is a view similar to that of FIG. 5 showing however the condition within which the extrusion press is ready for commencing the extrusion.

At the extruding station, referring to FIGS. 5 and 6, the mandrel 6 is moved forwardly, breaks the foil of seal block 20, and engages the interior conical surface **7*b* of the hollow billet 7, the internal part of the container 2 thereby being completely sealed in a reliable manner. Thereafter, the stem 5 is moved forwardly still further, as shown within FIG. 1, thereby increasing the pressure of the pressure medium 21, by means of the movement of the seal block 20, to a predetermined level sufficient to initiate the extrusion operation whereupon the billet 7 is extruded through and by means of the extruding die 3. During commencement of the extrusion operation, the lock plate 15 is interposed between the second large diameter portion 6*b* of the mandrel 6 and the lock slide 13, and consequently, the mandrel 6 is moved forwardly by means of the lock plate 15 as a result of the forward movement of the piston 13*a* within the cylinder 12**.

Since it is necessary to increase the pressure of the pressure medium to an extrusion starting pressure P, which is greater than the normal extrusion pressure P*s* by an amount approximating 5–10 percent, during starting of the extrusion operation, an additional pressure $\Delta P$, that is, $\Delta P = P_i - P_s$, is applied to the billet 7 as a result of the forward movement of the mandrel 6. More particularly, when the pressure of the pressure medium within the container 2 reaches the normal extrusion pressure P*s* as a result of the forward movement of the stem 5, the mandrel 6 is moved forwardly by means of the cylinder 12 in a manner, as previously mentioned, such that the conical portion **6*c* of the mandrel 6 is urged into contact with the conical surface 7*b* of the billet 7 thereby extruding the leading end portion of the billet 7** through the die hole. Due to this initial extrusion, the hollow billet is supplied with a predetermined amount of tension whereby, when the extrusion pressure is equal to or greater than the pressure P*i*, the extrusion operation can be started as the pressure of the pressure medium is effectively increased to a higher level by an amount equal to $\Delta P$.

Thereafter, the pressure of the pressure medium is maintained at the normal extruding pressures P*s* and, thus, the normal extrusion operation can be continuously performed subsequent to the initial extrusion. During the extrusion, the compression load, applied to the mandrel 6, is in turn transmitted, through means of the lock plate 15, to the lock slide 13 which is held in place by means of the piston **13*a* upon which the pressure within cylinder 12** acts.

When the extrusion has been completed, the fluid under pressure is drained from the main cylinder 9, and at the same time, the fluid under pressure is also drained from the cylinder 12. Subsequently, pressure is applied to the rod side of the piston portion **13*a* so that the lock slide 13 is moved rearwardly in the direction denoted by means of the arrow Y', and consequently, a gap is provided or defined between the second large diameter portion 6*b* of the mandrel 6 and the lock slide 13, and the lock plate 15 is able to be moved out of the gap and from the position interposed between the large diameter portion 6*b* of the mandrel 6 and the lock slide 13** in the direction denoted by means of the arrow X.

Thereafter, the first piston portion **6*a* of the mandrel 6 and the piston 10 are also moved rearwardly to a position at which the second large diameter portion 6*b* slidably engages the bore 14 of the lock slide 13, and the stem 5 is likewise moved rearwardly to its initial starting position. As already described hereinabove, the fluid under pressure is drained from the cylinders 9 and 12 at the same time, and hence, the axial load applied to the mandrel 6** does not exceed the frictional force acting upon each component, and consequently, the mandrel is prevented from being damaged.

Figure 7:
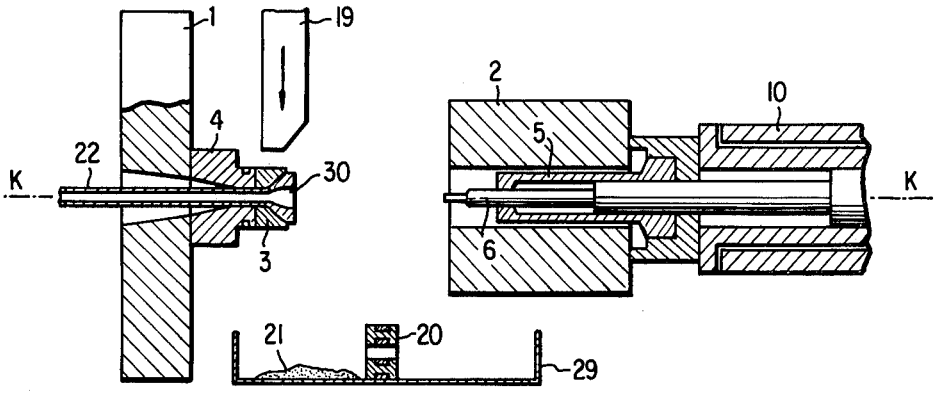

After the extrusion has been completed, the container 2 is moved rearwardly while holding the stem 5 and mandrel 6 stationary, as shown within FIG. 7, and the pressure medium 21 and the seal block 20 are recovered within a receptacle 29. Thereafter, a shearing device 19 is moved downwardly or radially inwardly so as to sever the end product 22 at a position defined between the die 3 and the die holding fixture 4, and subsequently, the die 3 and the material 30 remaining therewithin are also recovered within the receptacle 29. The die 3, pressure medium 21, and seal block 20 recovered within the receptacle 29 are then transferred to the auxiliary station position by suitable means, not shown, and utilized within the next extrusion operation.

While the present invention has been described with reference to a particular embodiment within which a hollow product is obtained by hydrostatic extrusion, it should be noted that a solid rod end product may likewise be obtained by using a seal block within which a through-bore, for passing the mandrel, is not provided and wherein only the stem is actuated, the mandrel not being moved.

As already described in detail hereinabove, since the rearward end of the container is sealed by means of the seal block which is provided separately from the stem, it is unnecessary to provide a stem having sealing structure thereon, and therefore, a stem having an extremely simplified structure can readily be manufactured. In addition, if a plurality of seal blocks are prepared, the seal members can be exchanged, at a safety station or position separated from the extrusion device, in an easy manner.

Furthermore, it is also possible to pre-dispose a unit ready for extrusion by utilizing a supply unit at a station or position separated from the extrusion device, that is, a die, billet, pressure medium, and seal block are prepared within a supply unit in advance of the extrusion operation. Consequently, the die, billet, pressure medium, and seal block are readily inserted into the container, as they are or as they have been pre-disposed by placing the supply unit coaxially in alignment with the axis of the extrusion device, and subsequently, upon completion of the extrusion operation, the stem having been moved forwardly, the pressure medium and seal block may be automatically recovered merely by moving the container rearwardly, whereby it is possible to shorten the time interval required for one extrusion cycle.

In accordance still further with the hydrostatic extrusion press embodying the present invention, while the lock slide serving as the mandrel holding device, which imparts a compression load to the mandrel so as to maintain the mandrel within a constant position, is movably supported by means of fluid under pressure, it is possible to reduce the force acting upon the mandrel during release of the extrusion pressure, and therefore, the mandrel is prevented from being damaged. Moreover, it is possible to minimize the driving power necessary for releasing the lock member, that is, the lock plate which is interposed between the mandrel and the holding device, that is, the lock slide, which retains the mandrel at a constant position, and therefore, it is easy to release the locked condition. In addition, since the mandrel is arranged to be forwardly movable independently of the stem, the initial setting of the hollow billet can be readily accomplished and, furthermore, the pressure required for the commencement of the extrusion operation can be easily increased by moving the mandrel forwardly.

Obviously, many modifications and variations of the present invention are possible in light of the above teachings. It is therefore to be understood that within the scope of the appended claims, the present invention may be practiced otherwise than as specifically described herein.

We claim:

1. A hydrostatic extrusion apparatus for extruding a billet which comprises:

a container movably disposed along the central axis of said extrusion apparatus;

a platen disposed in front of said container;

a supply unit charged with an extrusion die, a pressure medium, said billet and a seal block member for sealing said pressure medium within said supply unit;

a stem mounted on said platen for increasing the pressure of said pressure medium within said supply unit;

means for retaining said supply unit at a charging position such that the forward end of said supply unit is held in close contact with and in coaxial alignment with said container;

means for driving said stem so as to move said extrusion die, said pressure medium, said billet, and said seal block member into said container; and, means for extruding said billet through said extrusion die.

2. A hydrostatic extrusion apparatus according to claim 1 which further comprises:

a mandrel which is movable independently of and is slidably disposed within said stem, said mandrel extending through said means for driving said stem so as to project rearwardly thereof, said mandrel including a large diameter portion provided upon the rearward end thereof;

a lock slide movably supported by cylinder means disposed rearwardly of said large diameter portion of said mandrel, said lock slide having a bore larger in diameter than that of said large diameter portion of said mandrel; and, a lock plate movably interposed between said large diameter portion of said mandrel and said lock slide, said lock plate having a diameter larger than that of said bore of said lock slide and movable forwardly and rearwardly perpendicular to the extrusion direction.

3. A hydrostatic extrusion apparatus according to claim 1, wherein:

said supply unit comprises two divided supply unit members and said means for retaining said supply unit comprises a pivot shaft, a swinging arm pivotably interconnecting said supply unit members to said pivot shaft in such a manner that the concentric axis of each of said supply units is identical to the axis of the container, two cylinders for opening and closing said two divided supply unit members connected with said two divided supply unit members and the swinging arm, and two levers which are pivotably fixed upon the swinging arms and are respectively connected to said two divided supply unit members.

* * * * *

UNITED STATES PATENT AND TRADEMARK OFFICE

CERTIFICATE OF CORRECTION

PATENT NO. : 4,112,723

DATED : September 12, 1978

INVENTOR(S) : Akira Asari et al

It is certified that error appears in the above-identified patent and that said Letters Patent are hereby corrected as shown below:

Please correct the Priority Data to read as follows:

[30] Nov. 7, 1974 [JP] Japan.....49/128758

Nov. 7, 1974 [JP] Japan.....49/128759

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*